US010161728B2

(12) United States Patent
Bay

(10) Patent No.: US 10,161,728 B2
(45) **Date of Patent: *Dec. 25, 2018**

(54) LIGHTED NOCK

(71) Applicant: Clean-Shot Archery, Inc., Seattle, WA (US)

(72) Inventor: Larry R. Bay, Renton, WA (US)

(73) Assignee: Clean-Shot Archery, Inc., Seattle, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/592,117

(22) Filed: May 10, 2017

(65) Prior Publication Data

US 2017/0314899 A1 Nov. 2, 2017

Related U.S. Application Data

(63) Continuation of application No. 15/062,779, filed on Mar. 7, 2016, now Pat. No. 9,733,051, which is a (Continued)

(51) Int. Cl.
*F42B 6/06* (2006.01)
*F42B 12/38* (2006.01)

(Continued)

(52) U.S. Cl.
CPC ..... *F42B 6/06* (2013.01); *F42B 12/362* (2013.01); *F42B 12/38* (2013.01); *F42B 12/42* (2013.01); *Y10T 29/49826* (2015.01)

(58) Field of Classification Search
CPC ..... F42B 6/06
See application file for complete search history.

(56) References Cited

U.S. PATENT DOCUMENTS 4,340,930 A * 7/1982 Carissimi ..... F21V 33/008 362/110
4,547,837 A * 10/1985 Bennett ..... F42B 6/06 200/60

(Continued)

FOREIGN PATENT DOCUMENTS

CN 201636546 11/2010
CN 202339154 U 7/2012

OTHER PUBLICATIONS

Easton Archery Guide 2001-2002, 13 pages.

(Continued)

*Primary Examiner* — John Ricci
(74) *Attorney, Agent, or Firm* — Skaar Ulbrich Macari, P.A.

(57) ABSTRACT

A lighted nock assembly may include an LED/battery assembly, a nock housing and a nock body. The LED/battery assembly can include an LED and a battery. The nock housing can include a cylindrical structure so that an outer surface is inserted into a rear end of an arrow, wherein a portion of the LED/battery assembly is disposed within the nock housing. The nock body can be linearly movable towards and away from the nock housing. A portion of the LED/battery assembly is secured within the nock body such that moving the nock body away from the nock housing along a straight line turns the LED from a lighted state to an unlighted state.

14 Claims, 15 Drawing Sheets

Related U.S. Application Data continuation of application No. 14/330,125, filed on Jul. 14, 2014, now Pat. No. 9,279,649, which is a continuation of application No. 14/176,829, filed on Feb. 10, 2014, now Pat. No. 8,777,786.

(60) Provisional application No. 61/843,712, filed on Jul. 8, 2013.

(51) Int. Cl.
*F42B 12/36* (2006.01)
*F42B 12/42* (2006.01)

(56) References Cited

U.S. PATENT DOCUMENTS 4,856,792 A * 8/1989 Hardison ..... F42B 12/362 362/34
4,989,881 A * 2/1991 Gamble ..... F42B 6/003 362/110
5,058,900 A * 10/1991 Denen ..... F21V 33/008 200/276
5,067,731 A * 11/1991 Bickel ..... F42B 6/06 473/578
5,134,552 A * 7/1992 Call ..... F21L 15/00 362/109
5,141,229 A * 8/1992 Roundy ..... F42B 12/385 200/61.53
5,417,439 A * 5/1995 Bickel ..... F42B 6/06 473/578
5,987,724 A * 11/1999 Kleman ..... F41B 5/1446 269/38
6,017,284 A * 1/2000 Giles ..... F42B 6/06 473/578
6,123,631 A * 9/2000 Ginder ..... F42B 6/06 473/570
6,390,642 B1 * 5/2002 Simonton ..... F21V 33/008 362/203
6,736,742 B2 * 5/2004 Price ..... F42B 6/06 473/570
7,021,784 B2 * 4/2006 DiCarlo ..... F21V 33/008 362/109
7,331,886 B2 * 2/2008 Morris ..... F42B 6/06 473/578
7,837,580 B2 * 11/2010 Huang ..... F42B 6/06 473/570
7,922,609 B1 * 4/2011 Hajari ..... F42B 12/362 473/578
7,927,240 B2 * 4/2011 Lynch ..... F42B 6/06 473/570
7,993,224 B2 * 8/2011 Brywig ..... F42B 6/06 473/570
8,251,845 B2 * 8/2012 Bay ..... F41G 1/467 473/570
8,267,816 B1 * 9/2012 Hajari ..... F42B 12/362 473/578
8,342,990 B1 * 1/2013 Price ..... 473/570
8,657,709 B2 * 2/2014 Bay ..... F41G 1/35 473/570
8,777,786 B1 * 7/2014 Bay ..... F42B 6/06 473/570
9,279,649 B2 * 3/2016 Bay ..... F42B 6/06
9,733,051 B2 8/2017 Bay
2003/0171174 A1 * 9/2003 Price ..... F42B 6/06 473/578
2004/0184274 A1 * 9/2004 DiCarlo ..... F21V 33/008 362/458
2009/0062042 A1 * 3/2009 Huang ..... F42B 6/06 473/578
2009/0098960 A1 * 4/2009 Brywig ..... F21V 33/008 473/578
2011/0218062 A1 * 9/2011 Braun ..... A63B 65/02 473/578
2012/0100942 A1 * 4/2012 Minica ..... F42B 6/06 473/570
2013/0170900 A1 * 7/2013 Bay ..... F16B 29/00 403/343
2013/0267359 A1 * 10/2013 Pedersen ..... F42B 6/06 473/570
2014/0083406 A1 * 3/2014 Bednar ..... F41B 5/1415 124/91
2014/0148282 A1 * 5/2014 Marshall, Jr. ..... F42B 12/382 473/570
2014/0187362 A1 * 7/2014 Pedersen ..... F42B 12/382 473/570

OTHER PUBLICATIONS

International Search Report and Written Opinion of the International Searching Authority for International application No. PCT/US2014/045566, which is the international counterpart to the patent patent (U.S. Pat. No. 8,777,786) to the present application, dated Jan. 2, 2015, 13 pages.
Photographs of Ignitor lighted nock packages by NuFletch, believed to be on sale to the public prior to Jul. 8, 2013, 6 pages.
Facebook, video posted by Lumenock, "Lumenok Goes Pink to help fight Breast Cancer!" showing a still image of a frame at the 19th second of the video, (https://www.facebook.com/video.php?v=241116932567434), posting date unknown and showing a comment date of Jun. 30, 2011; 2 pages.
AMAZON.com, webpage (http://www.amazon.com/Allen-68425-Nock-Insert-Pack/dp/B00HBCEKA6) for purchasing Allen Company, Part No. 68425, package of "Nocks & Inserts", indicating a customer review date of Jun. 16, 2011; 4 pages.
Easton Technical Products, "Easton Target 2011" product catalog; 36 pages.
Brett Bueltel, "Firenock Challenge" blog entry (http://bowhunting.net/2010/11/firenock-challenge-141), posted Nov. 14, 2010; 4 pages.
nybowhunter.com, "New Lighted Nocks from Nockturnal for 2011" blog entry (http://www.nybowhunter.com/2011/01/new-lighted-nocks-from-nocktumal-for-2011.html) posted Jan. 6, 2011; 4 pages.
Backwater Outdoors, LLC, "Backwater Bowfishing 2011 Catalog" product catalog; 32 pages.
U.S. Appl. No. 61/729,901, filed Nov. 26, 2012, which is a priority application to U.S. Pub. App. No. 2014/0148282 and U.S. Pub. App. No. 2014/0148284; 26 pages.
U.S. Appl. No. 61/749,050, filed Jan. 4, 2013, which is a priority application to U.S. Pub. App. No. 2014/0148282 and U.S. Pub. App. No. 2014/0148284; 30 pages.
U.S. Appl. No. 61/749,262, filed Jan. 5, 2013, which is a priority application to U.S. Pub. App. No. 2014/0148282 and U.S. Pub. App. No. 2014/0148284; 29 pages.
Archive.org, archived web page (http://carbonexpressarrows.com/crossbow/crossbow-accessories/launchpad-crossbolt-lighted-nock) that discloses information regarding LAUNCHPAD lighted nock packages for crossbow bolts by Carbon Express, indicating an archiving date of May 1, 2013; 2 pages.
Photographs of product packages of LAUNCHPAD lighted nocks for crossbow bolts by Carbon Express, actual photograph date unknown but the product and packaging shown in the images is believed to have been publicly disclosed by Carbon Express and/or have been offered for sale to the public prior by Carbon Express prior to Jul. 8, 2013, 3 pages.

* cited by examiner

LIGHTED NOCK

PRIORITY

This application is a continuation of U.S. patent application Ser. No. 15/062,779, filed on Mar. 7, 2016, which is a continuation of U.S. patent application Ser. No. 14/330,125, filed on Jul. 14, 2014, now U.S. Pat. No. 9,279,649, which is a continuation of U.S. patent application Ser. No. 14/176,829, filed on Feb. 10, 2014, now U.S. Pat. No. 8,777,786, which claims the benefit of priority based on U.S. Provisional Application Ser. No. 61/843,712 filed on Jul. 8, 2013, and all of the foregoing applications are hereby incorporated by reference herein in their entirety.

FIELD

The present invention relates to arrow systems, and more particularly, to a lighted nock that can be deactivated to save battery power and prevent accidental activation in the field.

BACKGROUND

The use of lighted nocks for bow hunting is known. Lighted nocks are beneficial because they allow the hunter to track prey shot with an arrow, particularly in low-light conditions. However conventional lighted nocks are inconvenient to use.

Lighted nocks are typically lighted with a light emitting diode (LED) powered by a small battery, typically lithium-type. The nock is either clear or translucent so that the LED light source can light up the nock when the battery power is applied. Typically the act of inserting the battery/LED lights up the nock. The act of inserting the battery requires that the nock assembly be removed from the arrow shaft. Then the assembly must be re-installed once the nock is lit. The nock must be removed again to turn the light off.

The need to repeatedly remove the nock in the field is awkward, inconvenient and might lead to a missed shot opportunity. Also, the repeated removal and insertion of the nock can damage the arrow shaft and/or nock assembly over time. It is not desirable to pre-light the nocks prior to hunting because of battery life concerns and because of the potential that the lit nocks will spook prey if the lights are seen. Therefore, there is a need to provide an improved lighted nock system.

SUMMARY

The present disclosure teaches various example embodiments that address certain disadvantages in the prior art. A lighted nock system, apparatus and method are disclosed. An activation collar is provided to a nock to permit activation/de-activation of the LED light source without the need to remove the nock from the arrow shaft. A nock adaptor can be provided to a nock housing end portion to provide a range of outside diameters to the shaft-mating end of the nock. The nock adaptors thus permit the lighted nock system to fit a range of arrow shaft sizes (inside diameters). The lighted nock and a plurality of adaptor sizes can be provided together in a single package or kit that will fit most standard carbon and aluminum arrow shafts. A method of operating the lighted nock system and device is also disclosed.

According to certain example embodiments, a lighted nock device includes a nock body, the nock activation collar, a nock housing and LED/battery assembly. The nock body includes a first plurality of radially arrayed teeth and a plurality of gaps defined between the teeth. The nock activation collar is disposed adjacent the first plurality of teeth. The collar includes a second plurality of radially arrayed teeth projecting longitudinally outwards towards the first plurality of teeth. The second plurality of teeth are configured to interleave with the first plurality of teeth in a first rotational position when the second plurality of teeth are rotationally aligned with the gaps between the first plurality of teeth. The second plurality of teeth are configured to abut the first plurality of teeth in a second rotational position when the second plurality of teeth are rotationally aligned with the first plurality of teeth.

According to another example embodiment, a lighted nock kit for arrow shafts comprises a package. In the package are disposed a lighted nock, and first and second adaptors. The lighted nock assembly includes a shaft insertion portion having a first diameter dimension. The first adaptor includes an internal opening having an internal diameter conforming to the first diameter dimension of the shaft insertion portion of the lighted nock assembly. The first adaptor has a first adaptor outside diameter larger than the first end outside diameter dimension of the shaft insertion portion of the lighted nock assembly. The second adaptor includes an internal opening having an internal diameter conforming to the first diameter dimension of the shaft insertion portion of the lighted nock assembly. The second adaptor has a second adaptor outside diameter larger than the first adaptor outside diameter.

In a further example embodiment, a method of operating a lighted nock includes placing the lighted nock in a deactivated mode by rotating a nock activation collar with respect to a nock body until a plurality of teeth defined in the nock body are abutting and aligned with a plurality of teeth defined in the nock activation collar, thereby preventing the nock body from moving longitudinally inward towards a nock housing to close a light activation gap in response to pressure applied to a distal end of the nock body. The lighted nock is placed in a ready to fire mode by rotating the nock activation collar with respect to a nock body until the plurality of teeth defined in the nock body are offset from the plurality of teeth defined in the nock activation collar such that the plurality of teeth defined in the nock activation collar are aligned with gaps defined between the plurality of teeth defined in the nock body. The lighted nock is placed in a lit mode by pressing on the distal end of nock body when the lighted nock is in the ready to fire mode with a sufficient force to close the activation gap between the nock body and the nock housing. The lighted nock is returned to the ready to fire mode by moving the nock body distally away from the nock housing to open up the activation gap. All of the foregoing steps can be performed while the lighted nock remains inserted into the end of an arrow shaft.

The detailed technology and preferred embodiments implemented for the subject invention are described in the following paragraphs accompanying the appended drawings for people skilled in this field to well appreciate the features of the claimed invention. It is understood that the features mentioned hereinbefore and those to be commented on hereinafter may be used not only in the specified combinations, but also in other combinations or in isolation, without departing from the scope of the present invention.

DETAILED DESCRIPTION

Figure 1:
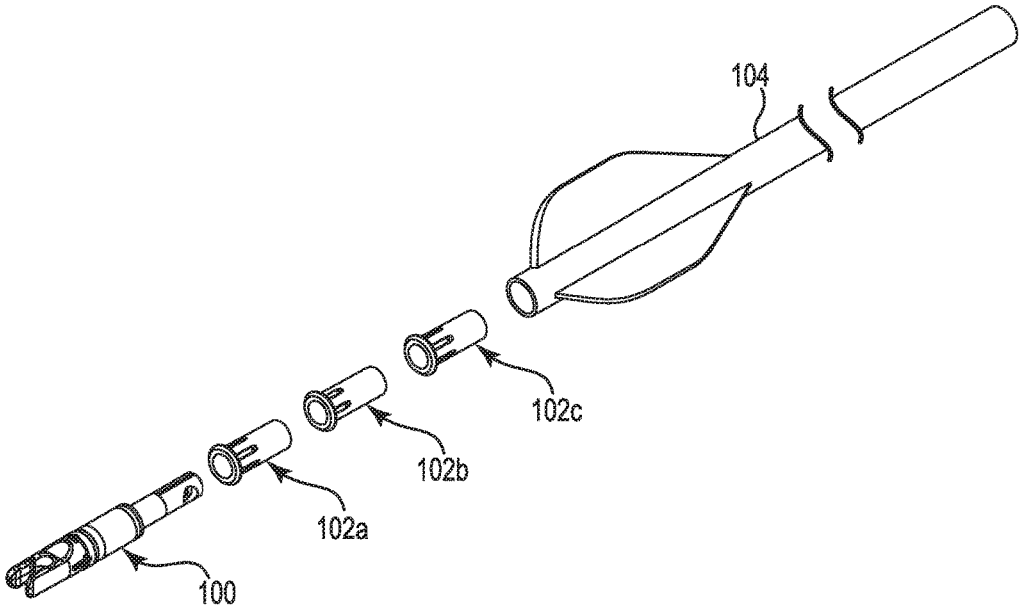
FIG. 1 is an exploded perspective view of a lighted nock system for an arrow shaft according to an example embodiment of the present invention.

In the following description, the present invention will be explained with reference to example embodiments thereof. However, these example embodiments are not intended to limit the present invention to any specific environment, applications or particular implementations described in these example embodiments. Therefore, description of these example embodiments is only for purpose of illustration rather than limitation. It should be appreciated that, in the following example embodiments and the attached drawings, elements unrelated to the present invention are omitted from depiction; and dimensional relationships among individual elements in the attached drawings are illustrated only for ease of understanding, but not to limit the actual scale.

While the invention is amenable to various modifications and alternative forms, specifics thereof have been shown by way of example in the drawings and will be described in detail. It should be understood, however, that the intention is not to limit the invention to the particular example embodiments described. On the contrary, the invention is to cover all modifications, equivalents, and alternatives falling within the spirit and scope of the invention as defined by the appended claims.

Referring to FIG. 1, the lighted nock assembly 100 is shown in axial alignment with three different size nock sleeves or nock adaptors 102*a*, 102*b* and 102*c*. Each adaptor has a different outside diameter (OD) corresponding to certain common inside diameters (ID) of arrow shafts 104. For example, adaptor 102*a* for 0.204 inch shaft ID, adaptor 102*b* for 0.233 inch shaft ID and adaptor 102*c* for 0.244 inch shaft ID are all shown. Other adaptor sizes can be provided without departing from the scope of the invention.

The inside diameter of each of the nock adaptors 102*a*, 102*b* and 102*c* is the same so that a single lighted nock assembly 100 can be used universally with all of the different OD size adapters. In one example, the inside diameter of the adaptors is 0.165 inches. In this example, the outside diameter of the portion of the nock assembly 100 that is inserted into the adaptor is sized to fit 0.165 inch ID arrow shafts. Thus, the nock assembly 100 would be used without an adapter for 0.165 inch ID arrow shafts, and with a respective adaptor 102*a*, 102*b* and 102*c* for 0.204, 0.233 and 0.244 inch shaft IDs. Currently 0.165 inch shaft IDs are the smallest widely used by hunters, but the present invention can be adapted to smaller shafts and used with a wider variety of adaptors without departing from the scope of the invention.

The feature of using one standard nock size with a variety of adaptors to fit with a variety of different arrow ID shafts reduces the need for manufacturing more than one size lighted nock. This feature also eliminates the need for the store to maintain inventory and merchandise more than one lighted nock size. The user also cannot accidentally purchase the wrong size of lighted nock for their particular shaft ID. Furthermore, the user now has the ability to use the same lighted nock for multiple arrow shaft ID sizes that they may use for targets or hunting by simply moving the lighted nock from shaft to another with the use of the adaptors that are all provided in the original package (kit).

Figure 2:
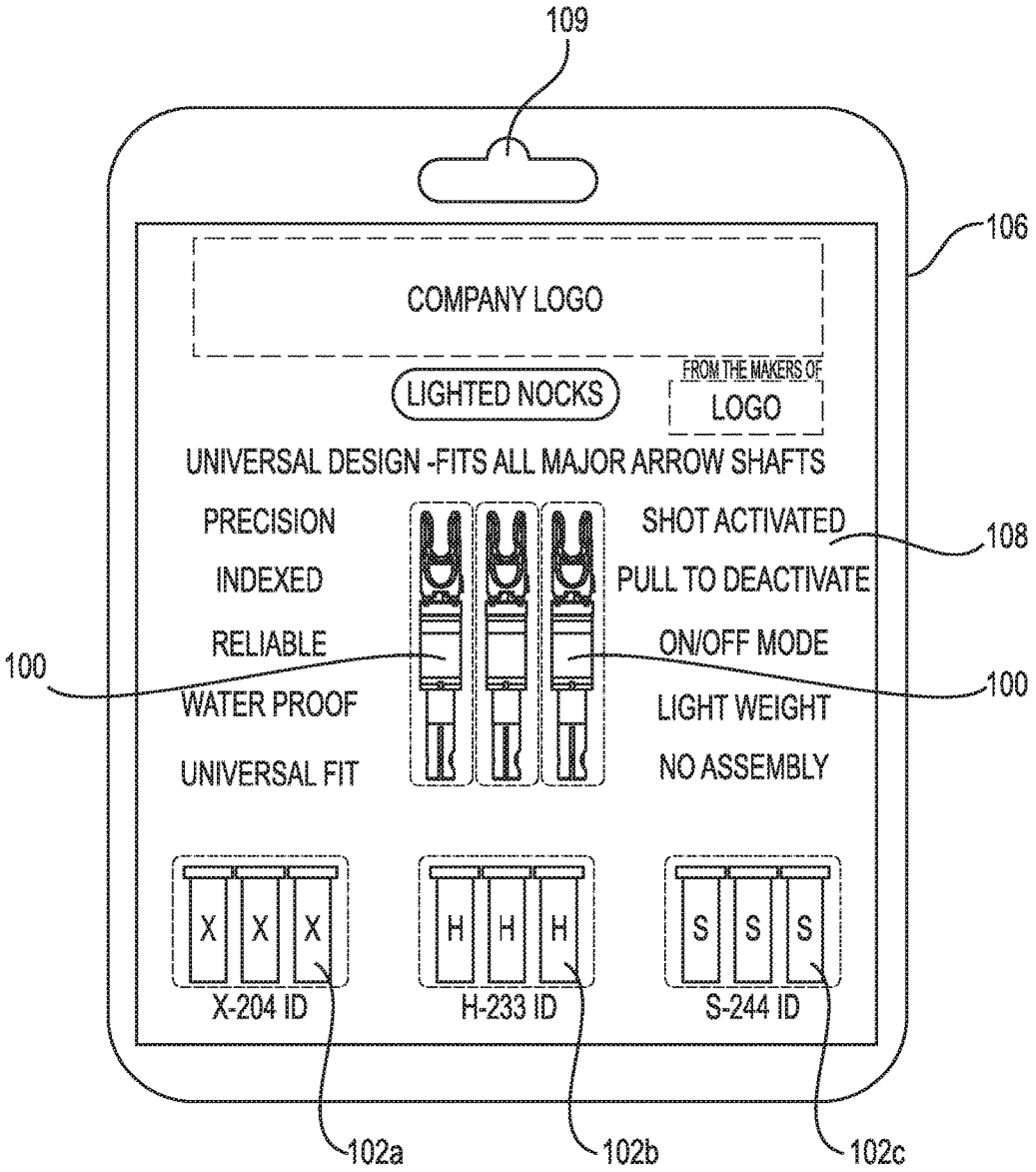
FIG. 2 is a front view of a packaged lighted nock system kit for arrow shafts according to an example embodiment of the present invention.

A single "universal fit" package or kit 106 can be provided, as shown in FIG. 2, that contains one or more lighted nock assemblies 100 and a variety of nock adaptors 102*a*, 102*b* and 102*c*, each in a plurality of sizes. In a preferred embodiment, there is the same number of nock adaptors as the number of lighted nock assemblies 100. More or fewer numbers of nock assemblies and knock adaptors can be provided in a single package without departing from the scope of the invention. Additionally, an instruction sheet can be disposed in the package or the instructions can be incorporated into the packaging itself.

The packaging comprises a full or partial plastic shell 108 including joined front and back panels in a preferred embodiment. An aperture 109 can be defined adjacent the top edge to allow for hanging by a post in the store display.

Figure 3:
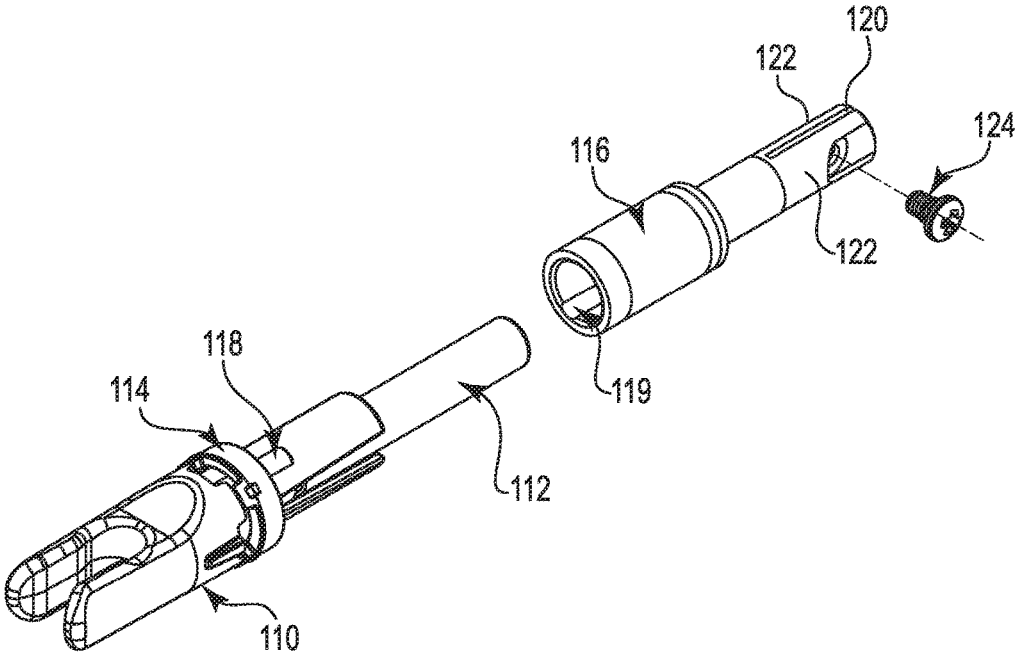
FIG. 3 is an assembly perspective view of a lighted nock system for arrow shafts according to an example embodiment of the present invention.

Referring now to FIG. 3, the lighted nock system or device 100 components are shown. The nock assembly comprises a nock body 110, a battery/LED assembly 112, a nock activation collar 114 disposed around the outside diameter of the first end of the nock body 110, and a nock housing portion 116. The LED end of the battery/LED assembly 112 is secured to the nock body 110. The second end of the nock body 110 defines a channel portion configured to receive the string of the bow. The housing portion 116 includes a first end configured for insertion into the inside diameter of the arrow shaft and a second end that defines an aperture for receiving the first end of the nock body 110. Raised male index tabs 118 adjacent the first end of the nock body are configured to engage respective recessed female index slots 119 defined in the second end of the housing 116.

The lighted nock system is assembled by securing the LED end of the LED/Battery assembly 112 to the nock body 110 via the first end of the nock body. In one embodiment, ultraviolet curable glue is used to accomplish the securing. Other securing methods and means can also be employed. For example, heat staking or ultrasonically welding the nock body to the LED end of the LED/Battery assembly can be used. A mechanical pin or "C" clip can also be driven through the nock body and the LED end of the LED/Battery assembly to join the two components in other alternatives.

The activation collar 114 is slid over the first end of the nock body 110 with the teeth facing away from the first end. The activation collar is installed with the LED in the "Off" or deactivated position, as will be discussed in detail below, to set the activation gap 180 for the lighted nock 100. Then the nock body assembly is mated with the nock housing 116 by inserting the first end of the nock body into the receiving end (second end) of the housing 116 until the components are fit together.

The battery end of the LED/battery assembly 112 is then secured to the housing 116. In the illustrated embodiment, the distal end of the battery portion is secured via a battery retention screw 124 that tightens the two halves 122 of the first end together to close the gap 120, which grips the battery portion securely. Alternatively, the battery portion can be glued in place or attached in a similar manner to the LED end as discussed previously. In the glued embodiment, the first end of the housing 116 need not be configured to form the gap 120. A simple bore can be provided with the necessary clearance for the battery portion distal end.

Figure 14:
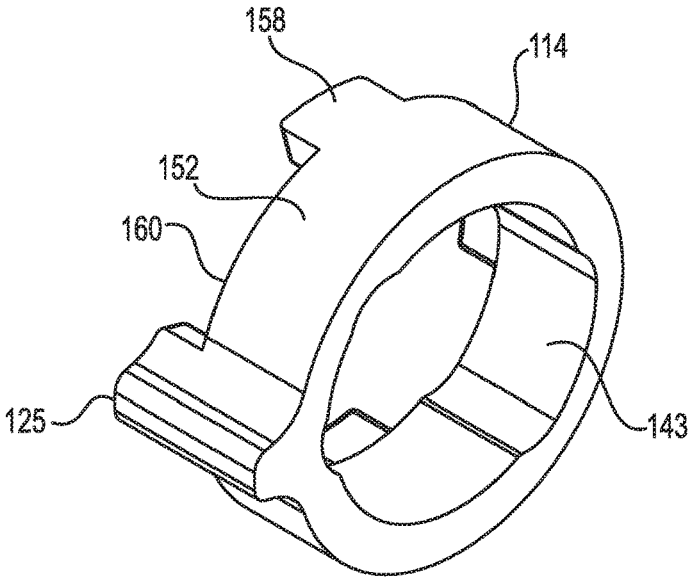
FIG. 14 is a perspective view of a nock activation collar for a lighted nock system according to an example embodiment of the present invention.
Figure 15:
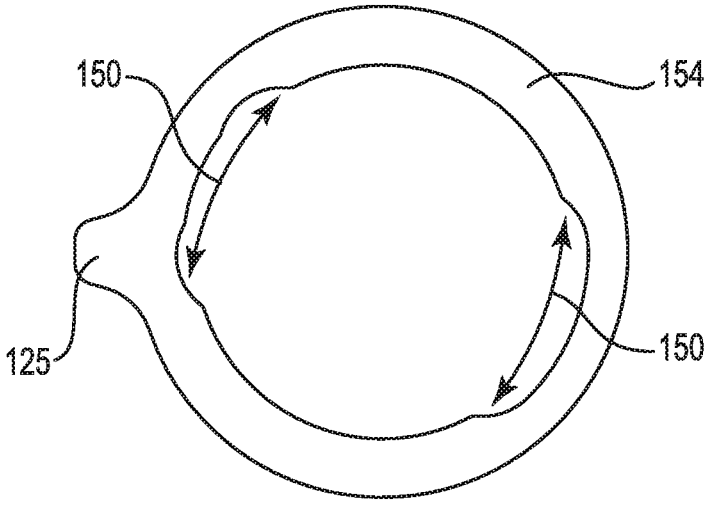
FIG. 15 is a rear view of a nock activation collar for a lighted nock system according to an example embodiment of the present invention.
Figure 16:
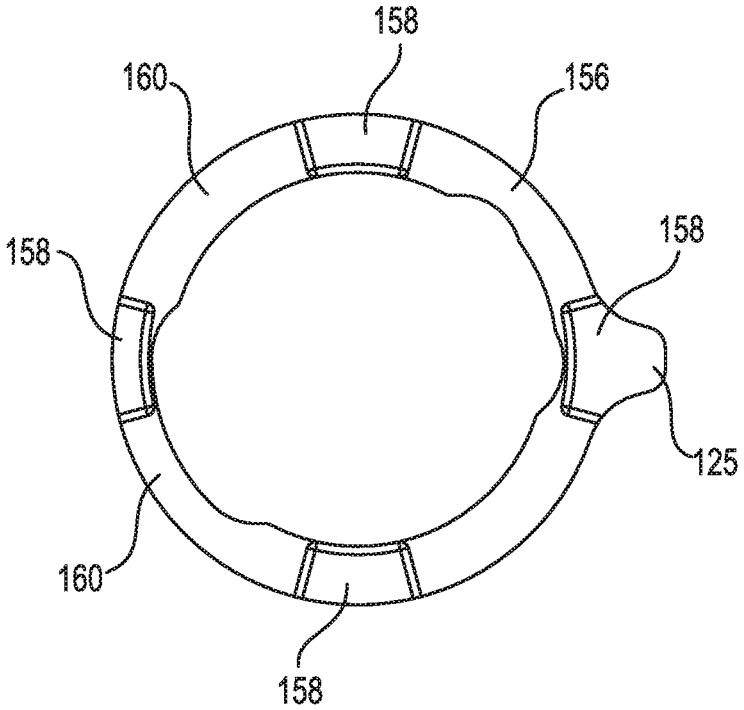
FIG. 16 is a front view of a nock activation collar for a lighted nock system according to an example embodiment of the present invention.
Figure 17:
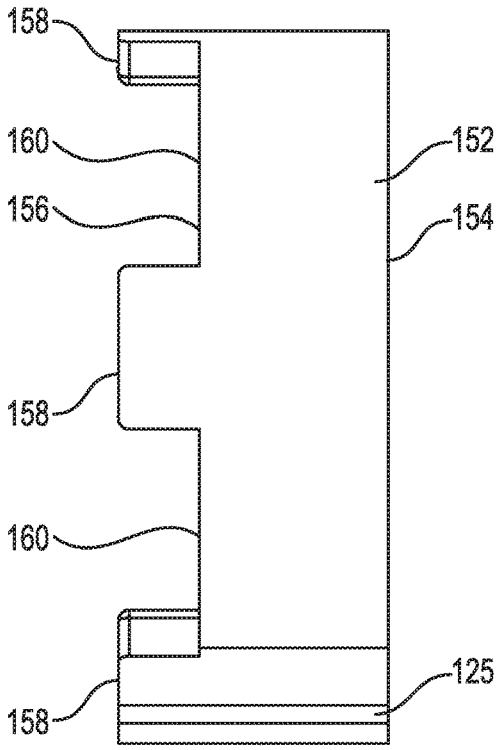
FIG. 17 is a side view of a nock activation collar for a lighted nock system according to an example embodiment of the present invention.
Figure 18:
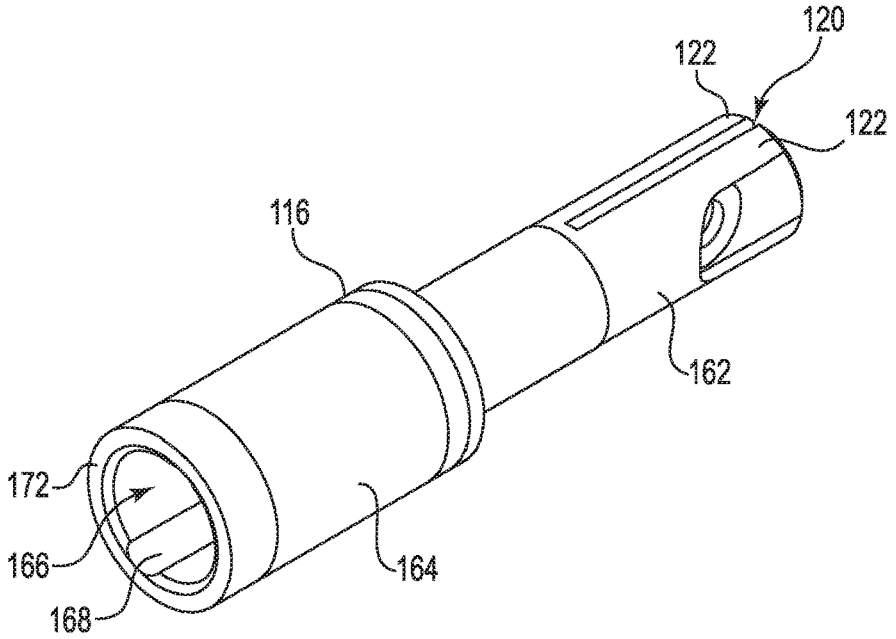
FIG. 18 is a perspective view of a nock housing for a lighted nock system according to an example embodiment of the present invention.
Figure 19:
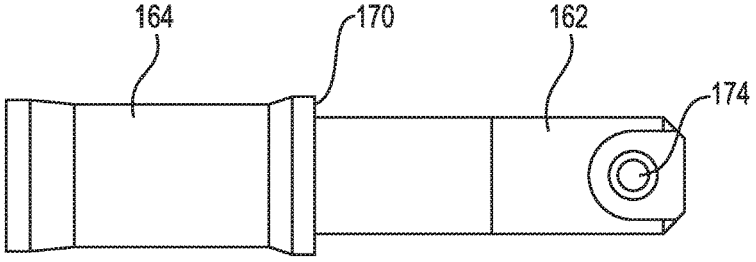
FIG. 19 is a side view of a nock housing for a lighted nock system according to an example embodiment of the present invention.
Figure 20:
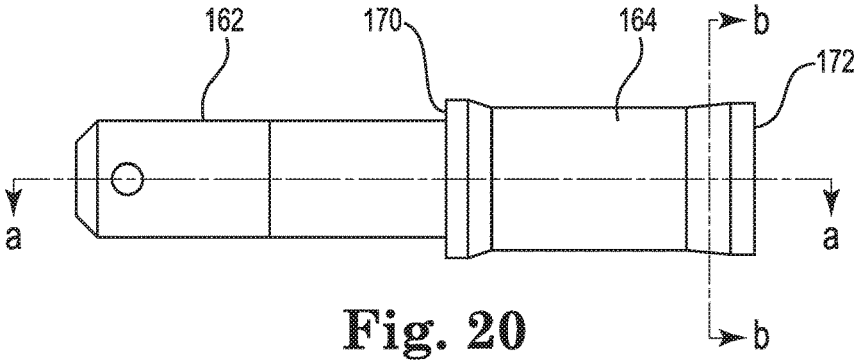
FIG. 20 is a top view of a nock housing for a lighted nock system according to an example embodiment of the present invention.
Figure 21:
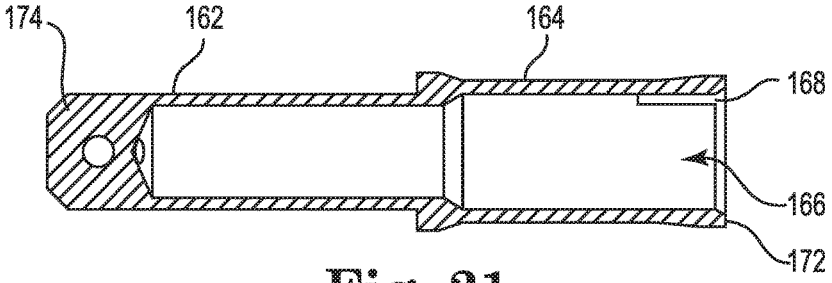
FIG. 21 is a cross-section side view of a nock housing for a lighted nock system according to an example embodiment of the present invention taken along line a-a of FIG. 20.
Figure 22:
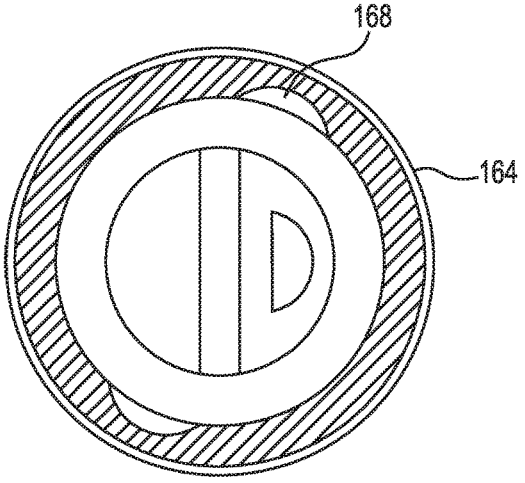
FIG. 22 is a cross-section end view of a nock housing for a lighted nock system according to an example embodiment of the present invention taken along line b-b of FIG. 20.

The lighted nock assembly 100 is rotationally indexable with respect to the arrow shaft in which it is inserted. The activation collar 114 includes a raised index tab 125 (shown in FIGS. 14-16) on the outside of the part to indicate a visual alignment target with the odd colored vane "Cock Vane" of the arrow. The lighted nock assembly 100 is installed into the arrow shaft with this index mark 125 aligned with the cock vane. This indexability feature is an advantage over other conventional lighted nocks because the present invention can be aligned to the stiff part of the arrow "spine" and cannot rotate out of position after several shots.

Another advantage of certain embodiments is that the index position will not be lost by operation of the lighted nock assembly. The raised male index tabs 118 of the nock body 110 engage the recessed female index slots 119 of the housing 116 when the two components are secured together. This configuration prevents rotation of the nock body 110 with respect to the nock housing 116, while permitting these respective components to still move longitudinally with respect to one another.

Figure 4:
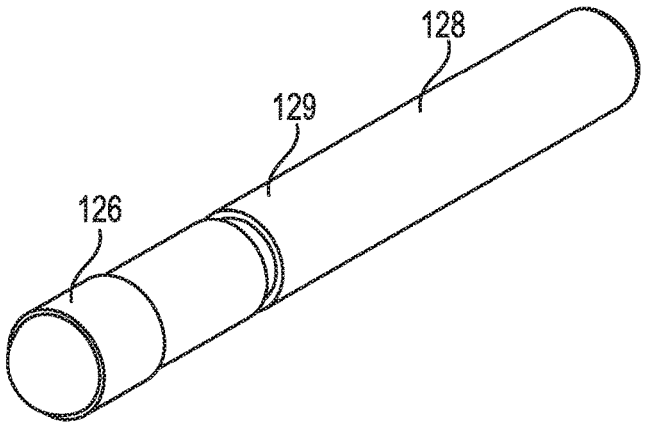
FIG. 4 is a perspective view of an LED and battery assembly for a lighted nock system according to an example embodiment of the present invention.
Figure 5:
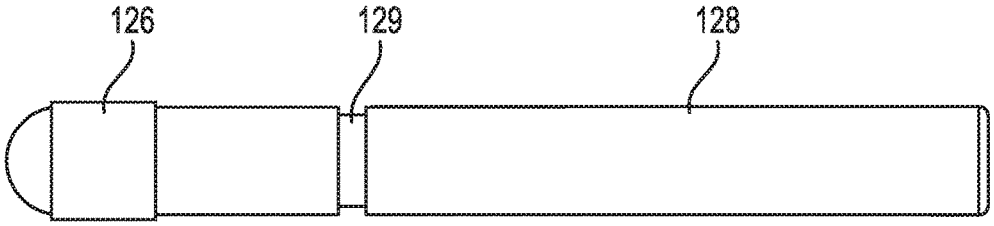
FIG. 5 is a side view of an LED and battery assembly for a lighted nock system according to an example embodiment of the present invention.
Figure 6:
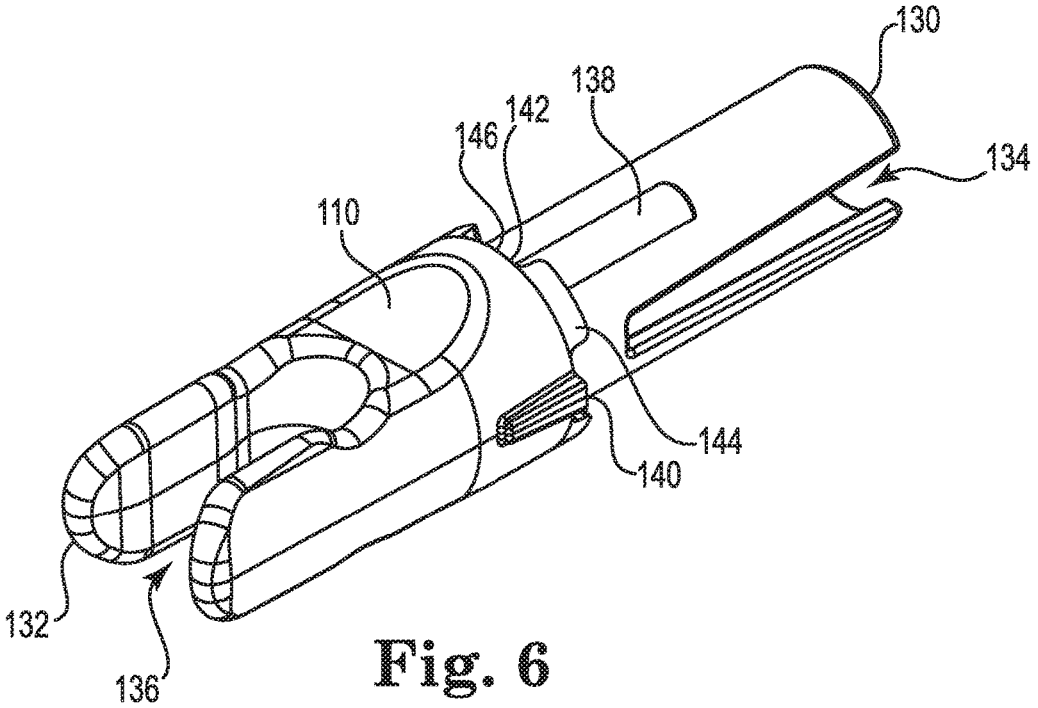
FIG. 6 is a perspective view of a universal nock for a lighted nock system according to an example embodiment of the present invention.
Figure 7:
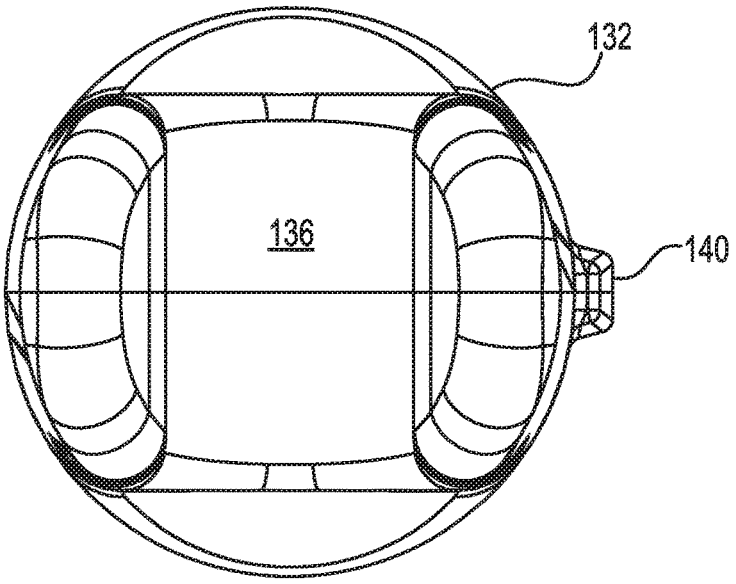
FIG. 7 is a rear view of a universal nock for a lighted nock system according to an example embodiment of the present invention.
Figure 8:
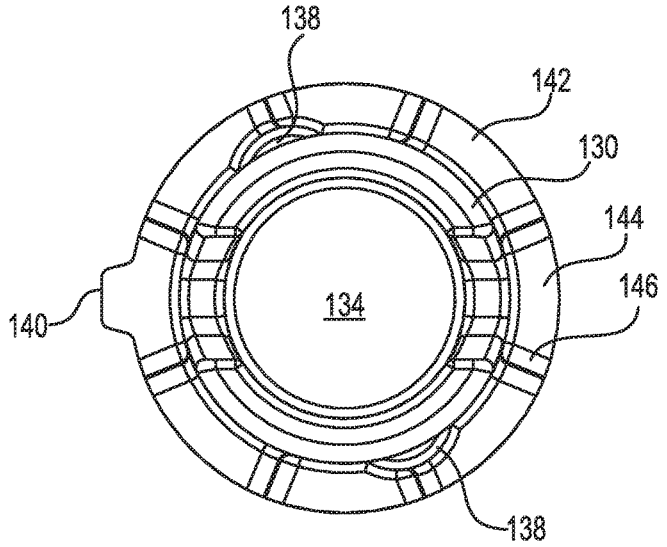
FIG. 8 is a front view of a universal nock for a lighted nock system according to an example embodiment of the present invention.
Figure 9:
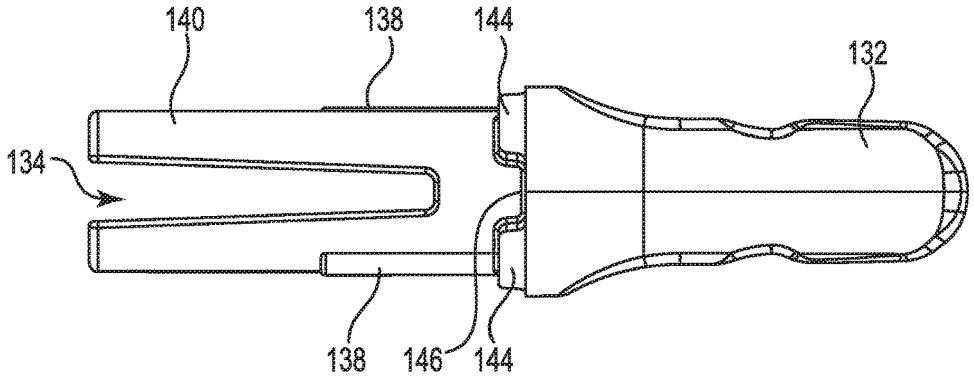
FIG. 9 is a bottom view of a universal nock for a lighted nock system according to an example embodiment of the present invention.
Figure 10:
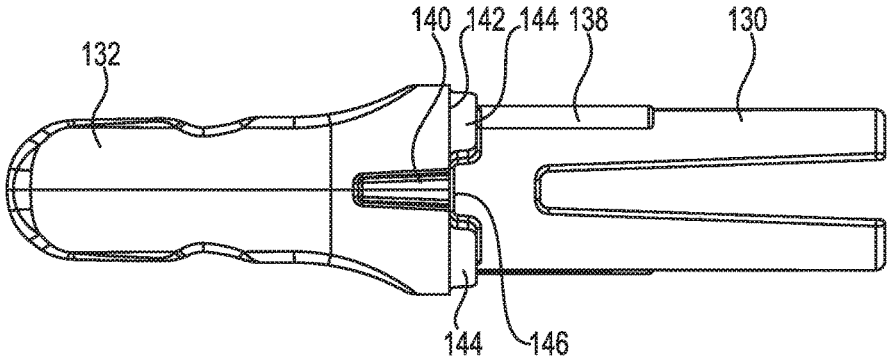
FIG. 10 is a top view of a universal nock for a lighted nock system according to an example embodiment of the present invention.
Figure 11:
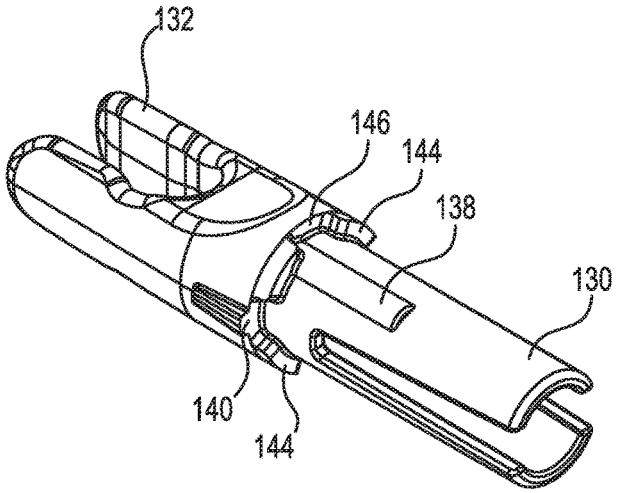
FIG. 11 is another perspective view of a universal nock for a lighted nock system according to an example embodiment of the present invention.
Figure 12:
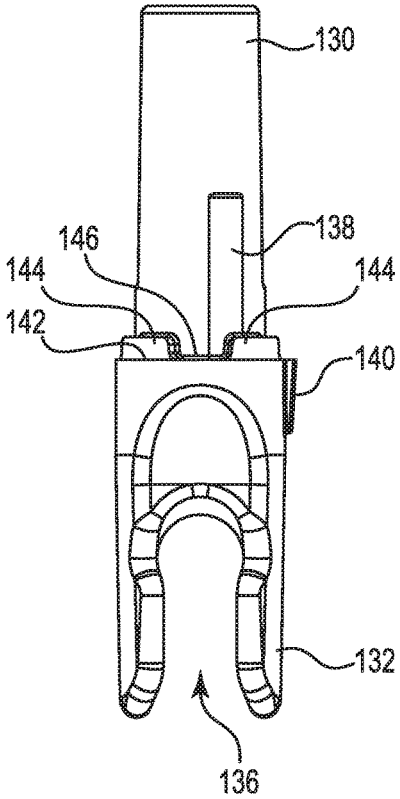
FIG. 12 is a side view of a universal nock for a lighted nock system according to an example embodiment of the present invention.
Figure 13:
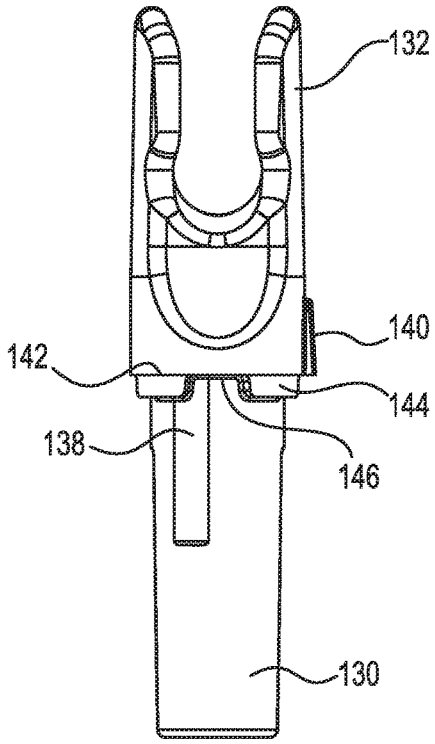
FIG. 13 is another side view of a universal nock for a lighted nock system according to an example embodiment of the present invention.

Referring to FIGS. 4-5, the LED/battery assembly 112 comprises an LED portion 126 and a battery portion 128. The LED/battery assembly is commercially available as a complete assembly from companies such as SHENZHEN POWER STATIONS LTD. and details of such suitable LED/battery assembly is disclosed in Chinese Patent 201636546, entitled "Electronic luminous rod and electronic product." Other suitable LED/battery assemblies can also be used without departing from the scope of the invention. The use of commercially available LED/battery assemblies allows for embodiments of the invention wherein the batteries and/or LED/Battery assemblies can be replaced.

The LED light can be of any brightness and color desired by the user. The battery is preferably a lithium type battery due to the size/capacity advantages of such type. However, other battery types can be used (including multiple batteries in series or parallel) without departing from the scope of the invention.

The LED/battery assembly 112 shown in FIGS. 4-5 appears in the off or deactivated state. In the off state, the LED portion 126 is spaced longitudinally away from the battery portion 128 to define a gap 129 between the respective portions. In this state, the circuit between the battery and LED components is open. The LED is activated, or turned on, by applying a force to contract the two portions 126 and 128 together to reduce or eliminate the gap 129. Closing the gap completes the internal circuit to energize the LED. The gap 129 is opened again by applying force to pull the two portions 126 and 128 apart to open the gap, thereby turning the LED off. In a preferred embodiment, there is a defined detent at each of the off and on positions so that the on and off positions can be maintained until a deliberate force is applied to move the respective components to the opposite state.

Referring now to FIGS. 6-13, various views of the nock body 110 are shown. The nock body 110 has a first end 130 and second end 132. The first end 130 is shaped to protrude towards the arrow shaft and insert into the nock housing. The first end 130 includes a hollow internal cavity or pocket 134 with a shape and diameter corresponding to the LED/battery assembly 112 so that the assembly can be received within the cavity 134. The second end 132 defines a channel 136 configured to accept a bow string.

A portion of the outer surface of the first end portion 130 is provided with a male or raised guide protrusion 138 (also designated as reference 118 in FIG. 3). This guide protrusion 138 is longitudinally elongated and has a profile corresponding to the recess in the housing (discussed below). The protrusion/recess pair cooperates to prevent rotation of the nock body 110 with respect to the nock housing 116. However, longitudinal "in-and-out" movement is permitted in order to allow the gap 129 in the LED/battery assembly to be opened and closed. The figures show two guide protrusions located opposite one another in the figures. However a single protrusion can be used, or more than two such protrusions can be used, without departing from the scope of the invention.

The second end 132 can take different forms or shapes to suit the particular application. For example, the channel can be eliminated or reduced for cross-bow applications where a relatively deep channel is not utilized.

A nock alignment tab 140 extends outward from the nock body. This tab 140 allows the user to feel and/or quickly observe the relative rotational position of the activation collar 114 with respect to the nock body 110.

The diameter of the first end 130 is smaller than the diameter of the second end 132. This configuration allows the first end 130 to be inserted into the housing 116, while the second end 132 remains external to the housing 116. The interface between the first and second ends forms a stop surface 142. A plurality of teeth 144 protrude forward from the stop surface 142 toward the first end 130. The teeth 144 are radially arrayed around the stop surface 142 to define a groove 146 or gap between each of the adjacent teeth.

Referring to FIGS. 14-17, the nock activation collar 114 will now be described in further detail. The collar 114 is generally ring-shaped. The inner surface 148 defines an aperture with a diameter slightly larger than the outside diameter of the first end 130 of the nock body 110. The inner surface also defines relief zones 150 to provide for clearance for the nock body protrusions 138 (or 118) through the full range of the collar's rotational travel. The width of the relief zones 150 is selected to define the extent of the rotational travel (e.g. 45 degrees) that the collar 114 can rotate with respect to the nock body 110. The rotational travel is restricted where the relief zone 150 ends and the male index tab or guide protrusion 118 contacts the interface of the relief zone and inner surface 148 nominal diameter.

The collar 114 outer surface 152 defines a raised index tab 125 that can be used for indexing of the nock assembly with respect to the arrow shaft, as described herein above. The index tab 125 can also be used for providing a visual and/or touch indication of the relative rotational position of the collar 114 with respect to the nock body 110.

A first end surface 154 of the collar spanning between the outer 152 and inner 148 surfaces is generally smooth. This first end 154 in operation faces the housing 116.

A second end surface 156 of the collar opposite the first and spanning between the outer 152 and inner 148 surfaces includes a plurality of radially arrayed teeth 158. A groove 160 or gap is defined between each of the adjacent teeth 158. This second end 156 in operation faces away from the housing 116.

Referring to FIGS. 18-22, the nock housing 116 will now be described in further detail. The housing 116 has a first end portion 162 configured to be inserted into an adaptor or into the open end of an arrow shaft with an ID of 0.165". Other diameters are also contemplated. The housing 116 also has an opposing second end portion 164 configured to receive the first end of the nock body 110 and the battery portion of the LED/battery assembly 112.

An internal channel 166 extends inwardly from the second end portion 164 and continues forward through a portion of the first end portion 162, thereby defining a channel depth. The shape and dimensions of the channel 166 conform to the outer dimensions of the first end 130 of the nock body 110 and the protruding portion of the battery portion 128. The female guide recesses 168 (reference 119 in FIG. 3) are defined in the channel corresponding to the male guide protrusions 118 or 138 of the nock body.

A shaft insertion stop surface 170 is defined at the juncture of the first 162 and second 164 portions of the housing 116. This stop surface 170 abuts the end surface of the arrow shaft (or an adaptor 102) to define the insertion depth of the nock assembly.

The outer end surface 172 of the second end portion 164 defines a stop surface defining the insertion depth of the nock body 110 until contact is made with the collar 114. The smooth end 154 of the collar 114 can freely slide against the smooth end surface 172.

A tip portion 174 of the first end 162 can be split into a plurality of segments 122 separated by a gap 120 therebetween. A perpendicularly aligned screw hole 174 in one segment and threads in the opposing segment allows the respective segments 122 to be brought together to close the gap 120 by tightening a screw fastener 124. This tightening action secures the battery end 128 of the LED/battery assembly 112 to the housing 116. Such securing also secures the nock body 110 to the housing because the LED portion 126 of the LED/battery assembly 112 is also secured to the nock body 110. Alternatively, the distal battery end of the LED/battery assembly can be secured to the housing 116 by other means, such as glue. In such alternative, the screw and split segments of the tip 174 are unnecessary.

Figure 23:
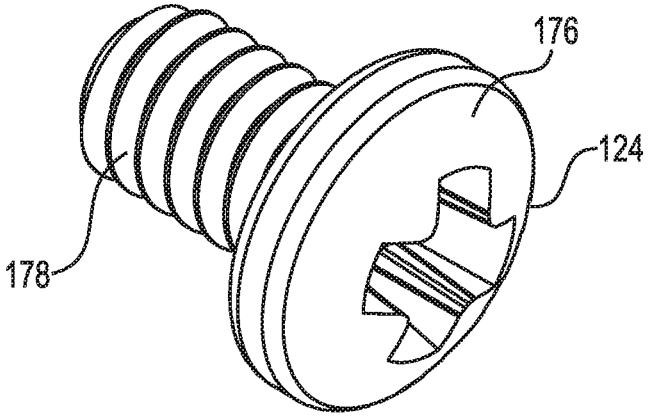
FIG. 23 is a perspective view of a battery retention screw for a lighted nock system according to an example embodiment of the present invention.
Figure 24:
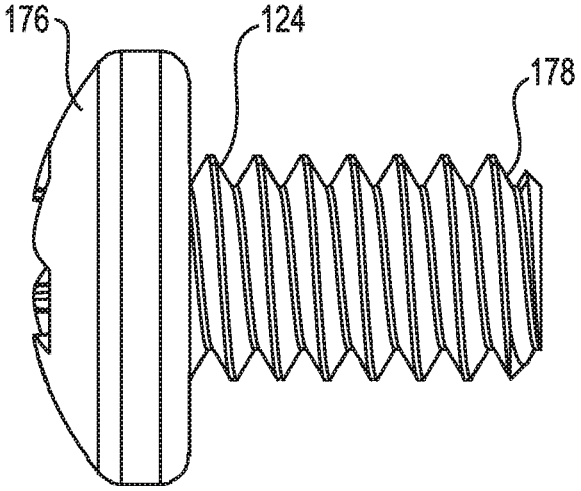
FIG. 24 is a side view of a battery retention screw for a lighted nock system according to an example embodiment of the present invention.

The battery portion retention screw 124 according to one example embodiment is shown in FIGS. 23-24. The screw 124 comprises a head 176 configured to engage a screw driver and a threaded body 178.

Figure 31:
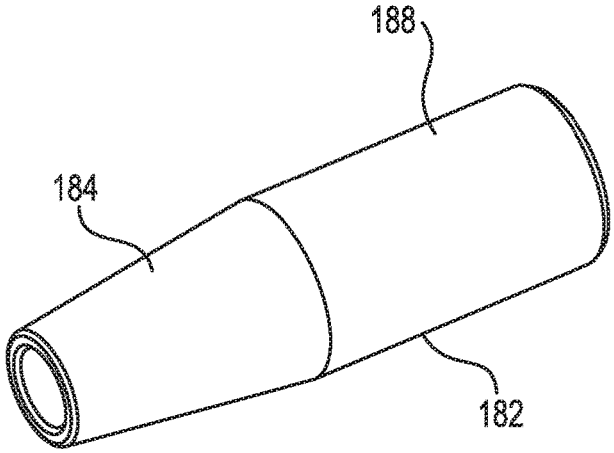
FIG. 31 is a perspective view of a shaft adapter for a lighted nock system for arrow shafts according to an example embodiment of the present invention.
Figure 32:
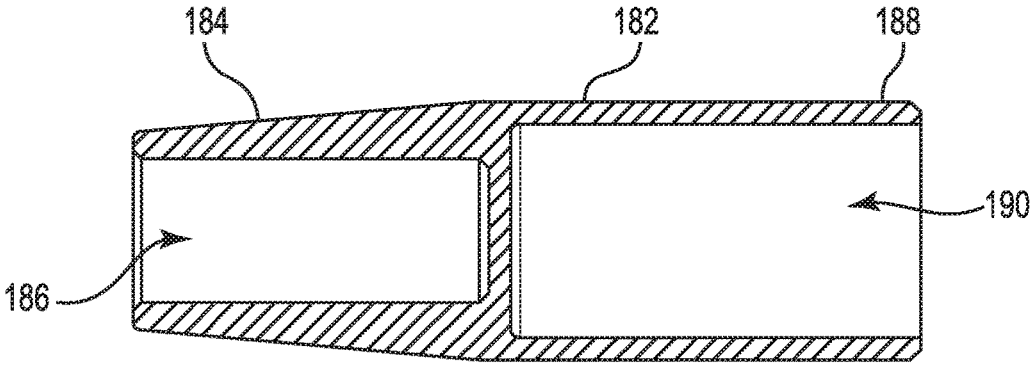
FIG. 32 is a longitudinal cross section side view of a shaft adapter for a lighted nock system for arrow shafts according to an example embodiment of the present invention.

A shaft adaptor 182 for solid core shafts is shown in FIGS. 31-32. Some arrow shafts, such as those used for bowfishing, are solid, so they do not have a hollow center to allow insertion of the first end of the housing 161 into the arrow shaft. The adaptor 182 has a first end 184 defining a first aperture 186 sized and shaped to receive the first end of the nock housing as if the adaptor 182 were a hollow shaft. The adaptor 182 also has a second end 188 that defines a second aperture 190 sized and shaped to fit over a portion of the rear end of the arrow shaft. The inside diameter of the second aperture 190 closely conforms the arrow shaft's outer diameter for a snug fit. Glue can also be applied to the end of the arrow shaft for added securing of the adaptor 182 to the shaft.

Figure 25:
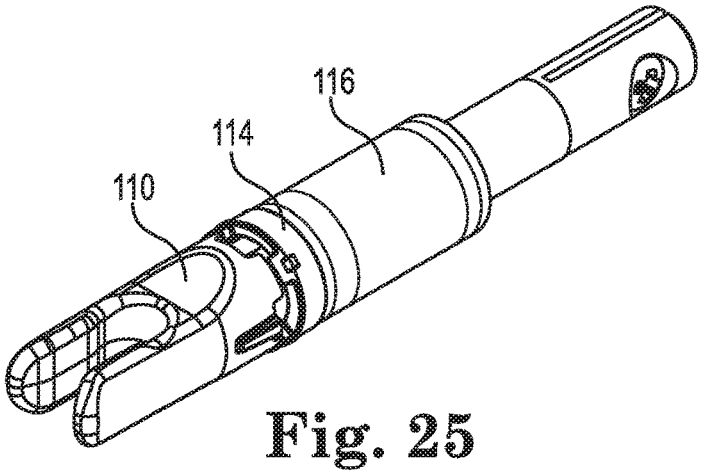
FIG. 25 is a perspective view of a lighted nock system for arrow shafts in a deactivated mode according to an example embodiment of the present invention.

The operating modes of the lighted nock assembly will now be described with respect to FIGS. 25-30. FIGS. 25 and 28 illustrate the lighted nock system in the deactivated mode. In this mode, the nock activation collar 114 is rotationally offset 45 degrees counterclockwise with respect to the nock body 110 activation alignment orientation such that each of the tabs or teeth 144 of the nock body 110 abuts a corresponding tooth 158 of the collar 114. This tooth-to-tooth alignment prevents the activation gap 180 (approximately 0.030 inches-corresponding to the gap 129 of the LED/battery assembly) between the collar 114 and nock body 110 from closing even in the presence of pressure applied to the second end 132 of the nock body 110. Thus, the LED will not light up even if the arrow is drawn back in the bow and shot.

The deactivated mode is useful when the lighted mode of the arrow is not desired, such as during storage, transport, loading an arrow onto the bowstring or when target shooting in bright sunlight. It is desirable to practice with the arrow in the same weight and balance configuration as it will be in when hunting or shooting at game (prey) when it is appropriate to have nock light up. Conventional lighted nocks are undesirable to use for practice shooting because the batteries will be used up needlessly. Removing the battery to turn off the nock, if even possible, will dramatically alter the weight and balance of the arrow, so that the practice shot does not predict the arrow as it will be shot with the lighted nock. And repeated removal of the nock can weaken and damage the arrow shaft. The deactivated mode of the present invention therefore solves the above-noted problems with conventional lighted nocks.

Figure 26:
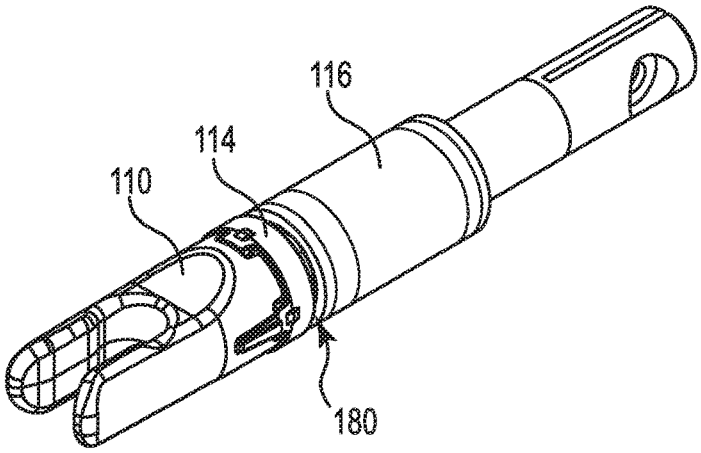
FIG. 26 is a perspective view of a lighted nock system for arrow shafts in a ready to fire mode according to an example embodiment of the present invention.
Figure 30:
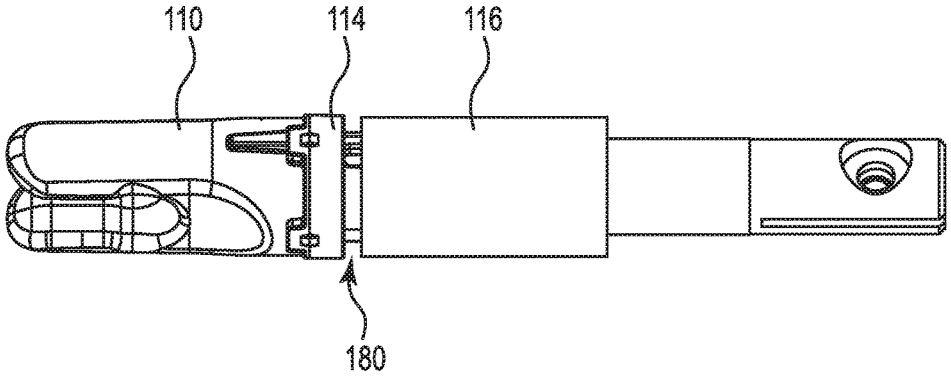
FIG. 30 is a side view of a lighted nock system for arrow shafts in a activated mode according to an example embodiment of the present invention.

FIGS. 26 and 30 illustrate the lighted nock system in the ready to fire mode. In this mode, the nock activation collar 114 is rotated 45 degrees clockwise from the deactivated alignment noted above such that each of the tabs or teeth 144 of the nock body 110 interleave with the corresponding teeth 158 of the collar 114. This alignment allows the activation gap 180 between the collar 114 and nock body 110 to close when pressure is applied by the bow string to the second end 132 of the nock body 110. Thus, the LED will light when the user shoots the arrow as the pressure from the bowstring will compress (close) the activation gap 180, and thus the gap 129, to energize the LED. This feature eliminates the possibility of the lighted nock activating when loading an arrow onto the string, which improves shot timing and reduces the likelihood that the prey notices the lit nock.

Figure 27:
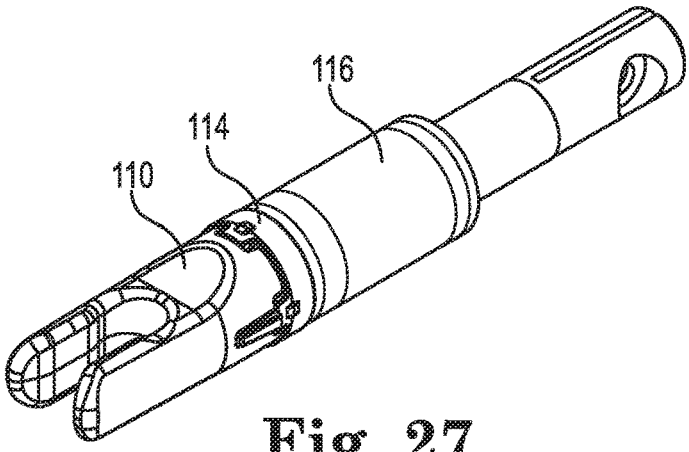
FIG. 27 is a perspective view of a lighted nock system for arrow shafts in a activated mode according to an example embodiment of the present invention.
Figure 28:
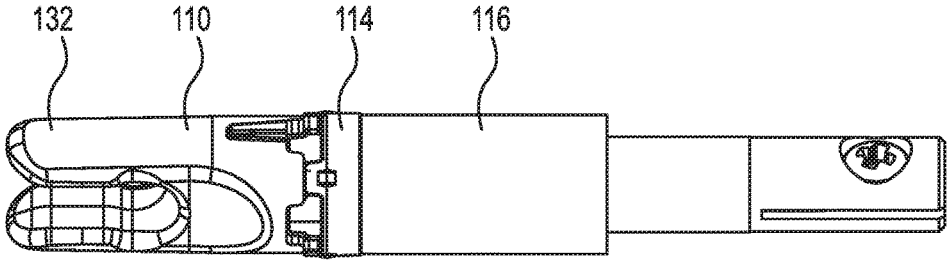
FIG. 28 is a side view of a lighted nock system for arrow shafts in a deactivated mode according to an example embodiment of the present invention.
Figure 29:
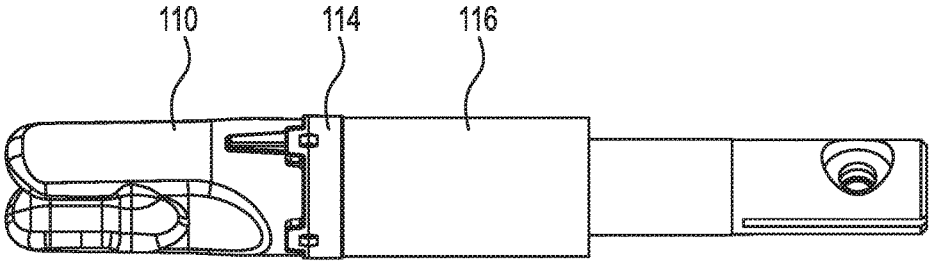
FIG. 29 is a side view of a lighted nock system for arrow shafts in a lighted or ready-to-fire mode according to an example embodiment of the present invention.

FIGS. 27 and 29 illustrate the lighted nock system in the activated mode after the gap 180 has been closed. The LED is now energized by the battery and the nock body 110 is lit.

The nock assembly can be unlit or turned off by pulling the nock body 110 longitudinally away from the housing 116 to open up the activation gap 180. This returns the lighted nock assembly to the ready to fire mode. Rotating the collar 114 clockwise with respect to the nock body 110 by 45 degrees engages the deactivated mode.

As described above, the lighted nock assembly can be turned on and off and set in deactivated mode without the need to remove the nock from the arrow shaft. The nock can be secured to the arrow shaft via any conventional means such as press-fitting, or by the securing method disclosed in U.S. Patent Application Pub. No. 2013/0170900, which is hereby incorporated fully herein as part of this application. The present invention can also be used with a laser broadhead as disclosed in U.S. Patent Application Pub. No. 2012/0035006, which is also hereby incorporated fully herein as part of this application.

The various components of the arrow insert described herein can be formed from a variety of materials without departing from the scope of the invention. In one embodiment, the universal nock is clear or translucent plastic. The collar 114 and adaptor 102 can be plastic or metal (e.g. aluminum or magnesium). Some components, such as screw 124 are preferably metal. The size and material of screw 124 can be altered to alter weight and weight distribution. Additional weights can be added to the lighted nock assembly internal to the arrow shaft to change arrow weight, weight distribution and flight characteristics as well.

The above disclosure is related to the detailed technical contents and inventive features thereof. People skilled in this field may proceed with a variety of modifications and replacements based on the disclosures and suggestions of the invention as described without departing from the characteristics thereof. For example, the invention is also applicable to cross bows, bowfishing, sling bow fishing/hunting, spear fishing guns and other projectiles that would benefit from lighted ends. Nevertheless, although such modifications and replacements are not fully disclosed in the above descriptions, they have substantially been covered in the following claims as appended.

What is claimed is:

1. A lighted nock comprising:

a light emitting unit including a light and a cylindrical battery, wherein the light is turned on or off by moving the light toward the battery or away from the battery;

a shaft adaptor which includes a cylindrical structure so that an outer surface is inserted into a rear end of a shaft, in which the battery is inserted into an inner space of the shaft adaptor; and a light operator which is inserted in an upper portion of the shaft adaptor, while a lower portion of the light operator receives the light, wherein the light is turned on or off by moving the light operator toward or away from the shaft adaptor, and wherein the light operator includes a raised first registration feature and the shaft adaptor includes a recessed second registration feature that is complimentary to the raised first registration feature such that the light operator cannot rotate relative to the shaft adaptor when the light operator is moved toward or away from the shaft adaptor.

2. The lighted nock of claim 1, wherein the light operator is a nock body, wherein the raised first registration feature is an index tab, wherein the recessed second registration feature is an index slot, and wherein the index slot extends longitudinally along an interior surface of the shaft adaptor.

3. The lighted nock of claim 1, wherein the shaft is a crossbow arrow shaft.

4. A lighted nock assembly, comprising:

an LED/battery assembly, including an LED and a battery;

a nock housing which includes a cylindrical structure so that an outer surface is inserted into a rear end of a shaft, wherein a portion of the LED/battery assembly is disposed within the nock housing; and a nock body linearly movable towards and away from the nock housing, wherein a portion of the LED/battery assembly is secured within the nock body such that moving the nock body away from the nock housing along a straight line turns the LED from a lighted state to an unlighted state, wherein the nock body includes a raised registration feature configured to prevent the nock body from rotating about its major axis while moving along the straight line.

5. The lighted nock assembly of claim 4 wherein the raised registration feature further prevents the nock body from rotating about its major axis with respect to the nock housing while the nock body is moved away from the nock housing along the straight line.

6. The lighted nock assembly of claim 4 wherein the raised registration feature further prevents the nock body from rotating about its major axis with respect to the shaft while the nock body is moved away from the nock housing along the straight line.

7. The lighted nock assembly of claim 4, wherein the raised registration feature is a guide protrusion projecting radially outwardly from an outer circumferential surface of the nock body.

8. The lighted nock assembly of claim 7, wherein the raised registration feature is longitudinally elongated and aligned with a longitudinal axis of the nock housing.

9. The lighted nock assembly of claim 4, wherein the raised registration feature is located on a forwardly protruding portion of the nock body.

10. The lighted nock assembly of claim 9, wherein nock body defines a rear portion that has a larger diameter than the forwardly protruding portion.

11. The lighted nock assembly of claim 9, wherein the rear portion defines a channel configured to accept a bow string.

12. The lighted nock assembly of claim 4, wherein the shaft is a crossbow arrow shaft.

13. A method of operating a lighted nock, the lighted nock including a nock body, nock receiver, LED and battery, the method comprising:

moving the nock body in a linear motion towards the nock receiver to turn on the LED;

moving the nock body in a linear motion away from the nock receiver to turn off the LED;

sliding a raised indexing feature of the nock body within a recessed indexing feature defined in the nock housing; and preventing the nock body from rotating relative to the nock receiver while moving the nock body towards the nock receiver to turn on the LED and while moving the nock body away from the nock receiver to turn off the LED via the sliding of the raised indexing feature of the nock body within the recessed indexing feature defined in the nock housing.

14. The method of claim 13, wherein the raised indexing feature of the nock body is an index tab and wherein the recessed indexing feature defined in the nock housing is an index slot.

* * * * *